US005148665A

United States Patent [19]

Kidani

[11] Patent Number: 5,148,665

[45] Date of Patent: Sep. 22, 1992

[54] ROVING BOBBIN CARRIER SYSTEM

[75] Inventor: Shuji Kidani, Ishikawa, Japan

[73] Assignee: Kabushiki Kaisha Murao and Company, Kanazawa, Japan

[21] Appl. No.: 666,631

[22] Filed: Mar. 8, 1991

[30] Foreign Application Priority Data

Apr. 28, 1990 [JP] Japan ..... 2-114168

[51] Int. Cl.[5] ..... D01H 13/26; D01H 11/00; B65H 73/00

[52] U.S. Cl. ..... 57/281; 57/300; 28/292; 28/295

[58] Field of Search ..... 57/281, 90, 300; 242/355 A; 28/292, 293, 294, 295

[56] References Cited

U.S. PATENT DOCUMENTS

| | | | |
|---|---|---|---|
| 1,119,993 | 12/1914 | Sharples et al. | 28/296 |
| 1,274,522 | 8/1918 | Dronsfield | 15/88.3 |
| 1,711,429 | 4/1929 | Senn | 28/292 |
| 2,277,657 | 3/1942 | Pinnelli | 15/88.3 |
| 2,385,039 | 9/1945 | Steinmetz | 15/88.3 |
| 2,701,376 | 2/1955 | Smith | 15/4 |
| 2,710,440 | 6/1955 | Bauer | 28/296 |
| 2,785,423 | 3/1957 | Martin | 15/88.3 |
| 3,289,266 | 12/1966 | Brown et al. | 28/294 |
| 3,410,406 | 11/1968 | Tsuda et al. | 57/281 X |
| 3,528,150 | 9/1970 | Schmid | 28/294 |
| 3,803,673 | 4/1974 | Kupper | 28/294 X |
| 3,928,884 | 12/1975 | Sutter | 15/88.3 |
| 4,267,983 | 5/1981 | Leu | 28/294 X |
| 4,461,050 | 7/1984 | Gantz et al. | 15/3 |
| 4,583,358 | 4/1986 | Krieger et al. | 57/281 |
| 4,598,869 | 7/1986 | Uchida et al. | 57/281 X |
| 4,620,435 | 12/1986 | Igel | 57/281 |
| 4,650,062 | 3/1987 | Uchida | 198/468.6 X |
| 4,720,967 | 1/1988 | Güttler | 57/90 X |
| 4,723,648 | 2/1988 | Hamatani | 198/465.1 X |
| 4,765,043 | 8/1988 | Yamashita | 28/294 |
| 4,772,174 | 9/1988 | Küpper | 198/465.2 X |
| 4,776,468 | 10/1988 | Kiriake | 198/803.12 X |
| 4,783,887 | 11/1988 | Trias | 28/292 |
| 4,793,036 | 12/1988 | Nakayama | 28/294 |
| 4,827,582 | 5/1989 | Yamashita | 28/293 |
| 4,840,124 | 6/1989 | Tadashima | 198/803.12 X |
| 4,841,719 | 6/1989 | Sasaki et al. | 57/281 |
| 4,846,618 | 7/1989 | Matsui | 242/35.5 A |
| 4,899,532 | 2/1990 | Sanno | 57/300 X |
| 4,905,356 | 3/1990 | Nakayama | 28/292 |
| 4,924,999 | 5/1990 | Kikuchi et al. | 198/468.6 X |
| 4,930,302 | 6/1990 | Yamamoto et al. | 57/90 X |
| 4,970,856 | 11/1990 | Taniguchi et al. | 57/281 |
| 4,999,988 | 3/1991 | Roder et al. | 57/90 X |
| 5,002,176 | 3/1991 | Lötzer et al. | 242/35.5 A |
| 5,010,725 | 4/1991 | Yasui et al. | 57/90 X |

FOREIGN PATENT DOCUMENTS

| | | | |
|---|---|---|---|
| 0314631 | 5/1989 | European Pat. Off. | 57/281 |
| 64-6128 | 1/1989 | Japan | 57/281 |

*Primary Examiner*—Daniel P. Stodola
*Assistant Examiner*—Michael R. Mansen
*Attorney, Agent, or Firm*—Oblon, Spivak, McClelland, Maier & Neustadt

[57] ABSTRACT

A roving bobbin carrier system having a single carrier line for conveying a plurality of full wound roving bobbins from a roving frame to a fine spinning frame and conveying a plurality of unwound roving bobbins from the fine spinning frame to the roving frame with the unwound roving bobbins converted into blank roving bobbins having no residual roving. A stock conveyor is provided at a midway position of the carrier line independently thereof. A residual roving removing device and first and second transfer mechanisms are provided in connection with the stock conveyor to convert the unwound roving bobbins to the blank roving bobbins. Accordingly, the conveyance of the full wound roving bobbins and the unwound roving bobbins can be efficiently carried out through the single carrier line.

7 Claims, 7 Drawing Sheets

ROVING BOBBIN CARRIER SYSTEM

BACKGROUND OF THE INVENTION

The present invention relates to a roving bobbin carrier system for supplying a plurality of full wound roving bobbins from a roving frame to a fine spinning frame and returning a plurality of unwound roving bobbins from the fine spinning frame to the roving frame after removing a residual roving from the unwound roving bobbins to provide blank roving bobbins.

FIG. 10 is a schematic illustration of a conventional roving bobbin carrier system. Referring to FIG. 10, a carrier line 1 is connected between a group of roving frames $R_1$ -$R_n$ and a group of fine spinning frames $S_1$ -$S_{Sn}$. A plurality of full wound roving bobbins obtained in the roving frames $R_1$ -$R_n$ are conveyed through the carrier line 1 in a direction depicted by an arrow T to the fine spinning frames $S_1$ -$S_n$. On the other hand, a plurality of unwound roving bobbins discharged from the fine spinning frames $S_1$ -$S_n$ contain a residual roving, and an amount of the residual roving attached to each unwound roving bobbin is not fixed. Therefore, it is necessary to completely remove the residual roving from the unwound roving bobbins and return the unwound roving bobbins as blank roving bobbins to the roving frames $R_1$ -$R_n$. In the case where the carrier line 1 is used commonly for the conveyance of the full wound roving bobbins and the conveyance of the unwound roving bobbins, the time required for removing the residual roving from the unwound roving bobbins causes a reduction in efficiency of the conveyance of full wound roving bobbins and the unwound roving bobbins.

To solve this problem, the carrier system as shown in FIG. 10 includes a bypass line 1*a* connected in parallel to the carrier line 1 for conveying the unwound roving bobbins. A residual roving removing device $A_O$ is provided in the bypass line 1*a* to remove the residual roving from the unwound roving bobbins staying in the bypass line 1*a*. In a modification of the bypass line 1*a*, a circulated route as shown by a dashed line 1*b* in FIG. 10 is connected to the carrier line 1, and a residual roving removing device $A_1$ is provided in the bypass line 1*b*.

FIG. 11 shows a structure of the carrier line 1 and the bypass line 1*a* or 1*b*. Referring to FIG. 11, the structure is of a roving bobbin hanging type in general, that is, the structure includes a hanger rail 10 having a sectional Ω-shaped groove, a plurality of moving members 12 movably mounted in the hanger rail 10, and a plurality of bobbin hangers BH connected through connecting rods 13 to the respective moving members 12. Thus, a plurality of roving bobbins RB are detachably hung from the respective bobbin hangers BH.

In the above carrier system provided with the bypass line 1*a* or 1*b*, the unwound roving bobbins are stored in the bypass line 1*a* or 1*b* for an indefinite period of time. Accordingly, a loss time is generated in returning the blank roving bobbins to the roving frames $R_1$ -$R_n$, thus causing a reduction in productivity of roving in the roving frames $R_1$ -$R_n$.

Furthermore, as the bypass line 1*a* or 1*b* must be located on the same plane as that of the carrier line 1, it is necessary to ensure a large factory site area.

OBJECT OF THE INVENTION

It is accordingly a primary object of the present invention to provide a roving bobbin carrier system which can efficiently convey the full wound roving bobbins and the blank roving bobbins through a single carrier line between the fine spinning frame and the roving frame.

It is another object of the present invention to provide a roving bobbin carrier system which can efficiently remove a residual roving attached to the unwound roving bobbins in a short time to provide the blank roving bobbins.

It is a further object of the present invention to provide a roving bobbin carrier system which can be located in a small-area factory site.

DETAILED DESCRIPTION OF THE INVENTION

Figure 1:
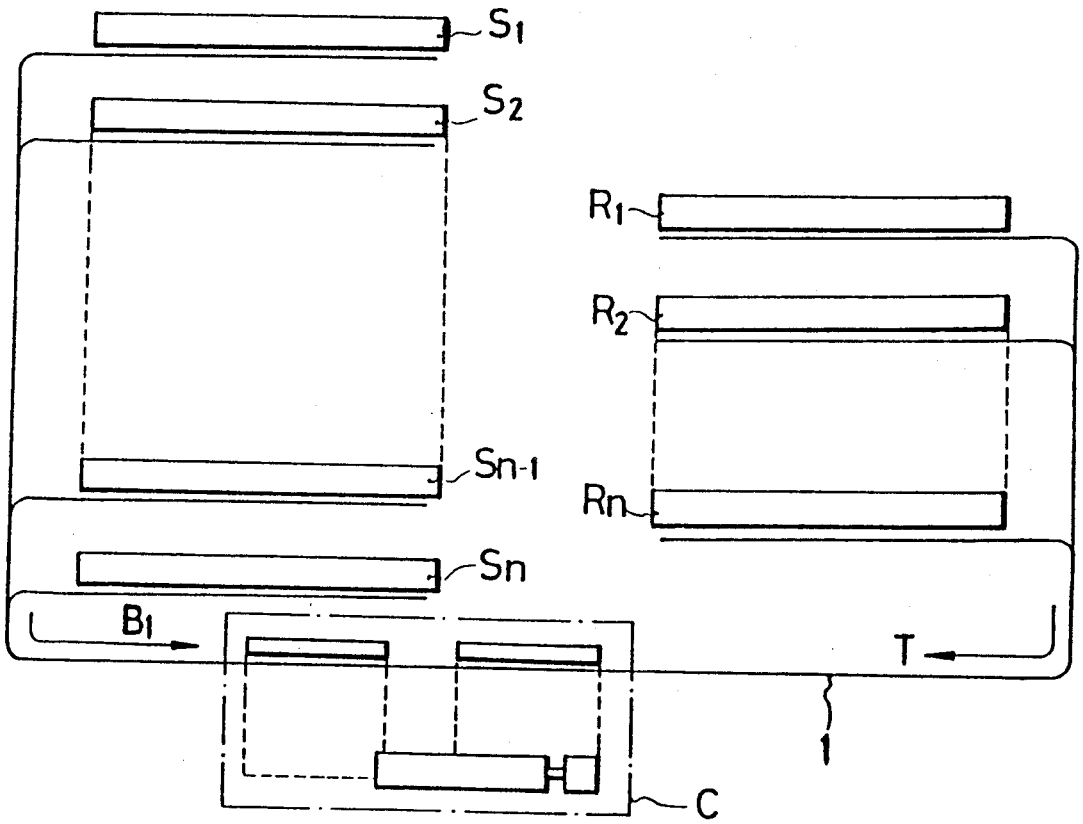
FIG. 1 is a general schematic plan view of a typical preferred embodiment of the present invention.
Figure 10:
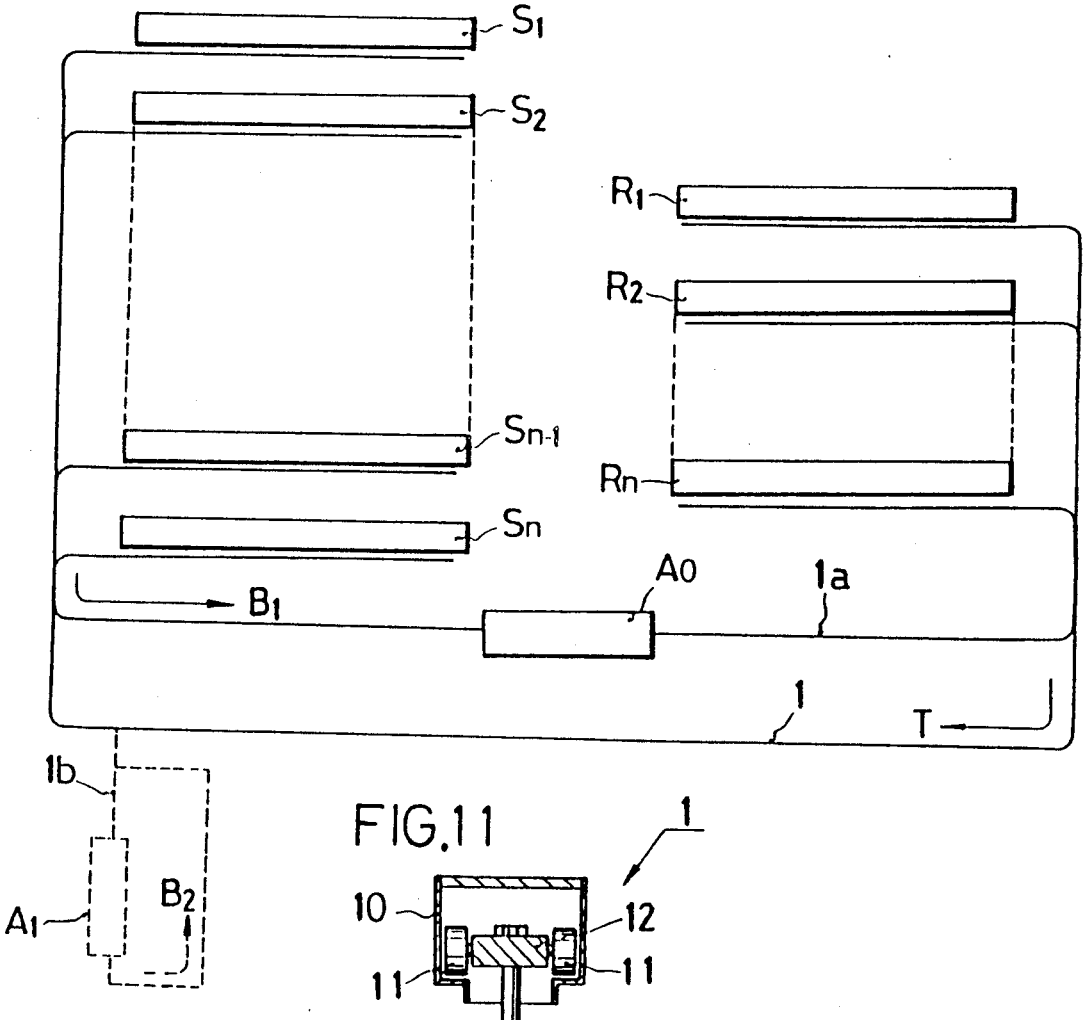
FIG. 10 is a general schematic plan view of the conventional roving bobbin carrier system.
Figure 11:
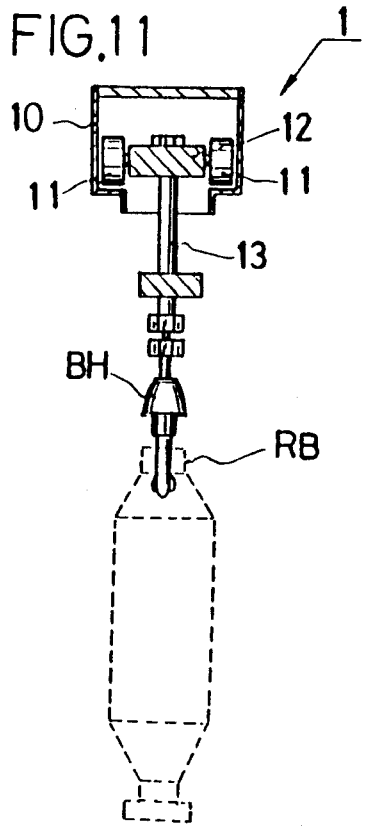
FIG. 11 is a vertical sectional view of the carrier line shown in FIG. 10.

FIG. 1 is a general schematic illustration showing a typical preferred embodiment of the present invention. A single carrier line 1 is provided between a group of fine spinning frames $S_1$ -$S_n$ and a group of roving frames $R_1$ -$R_n$. The carrier line 1 has a structure similar to that shown in FIG. 10. Full wound roving bobbins each having a roving fully wound at the roving frames are conveyed in a direction depicted by an arrow T, while unwound roving bobbins on which the roving is unwound at the fine spinning frames are conveyed in a direction depicted by an arrow $B_1$. The conveyance of the full wound roving bobbins and the conveyance of the unwound roving bobbins are carried out simultaneously and separately without overlapping each other.

Figure 2:
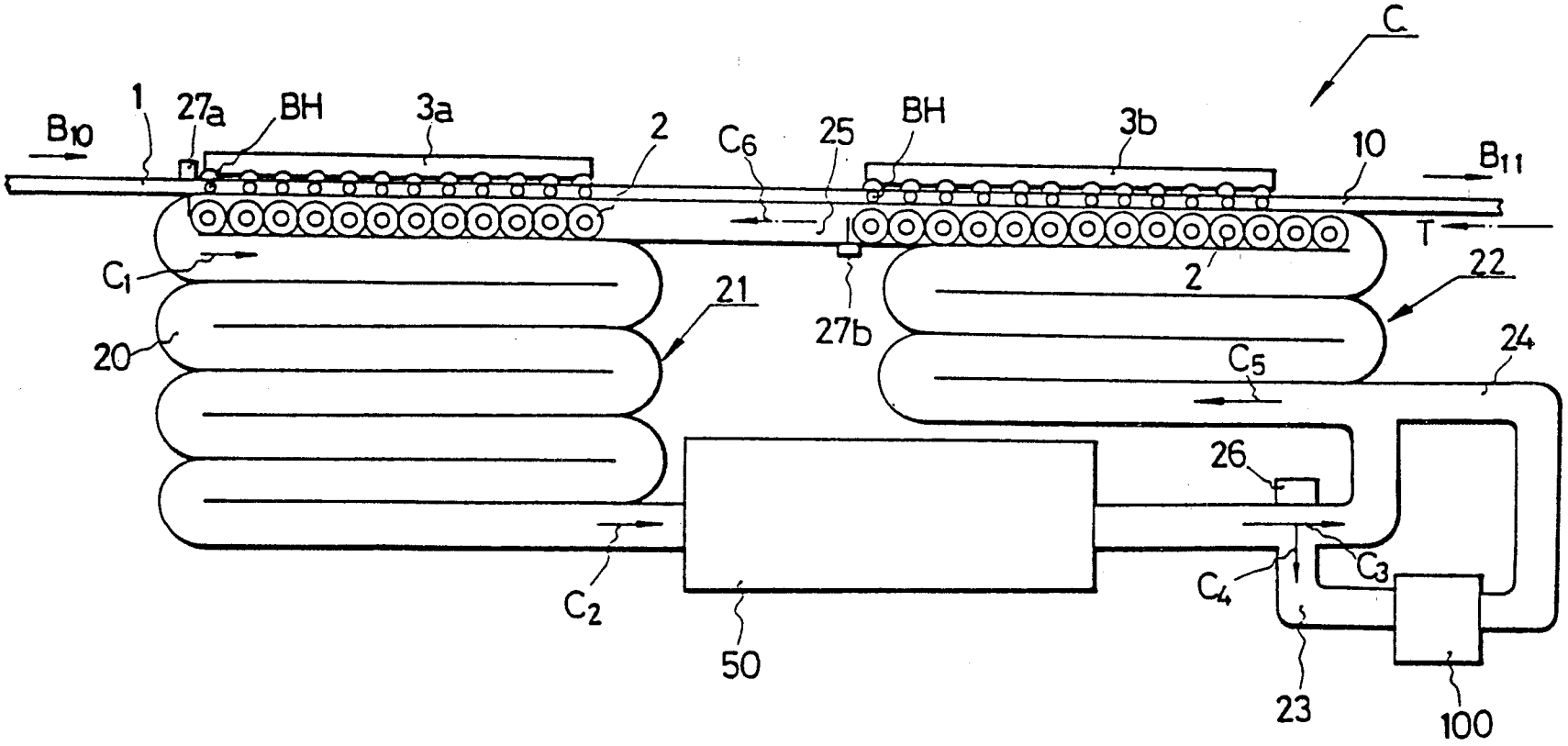
FIG. 2 is an enlarged plan view of a stock conveyor unit C shown in FIG. 1.

A stock conveyor unit C is provided adjacent to a part of the carrier line 1. FIG. 2 is an enlarged plan view of the stock conveyor unit C. The stock conveyor unit C is primarily constituted of a stock conveyor 20, first and second transfer mechanisms 3*a* and 3*b*, and a residual roving removing device 50. Although FIG. 2 illustrates that a rail 10 of the carrier line 1 is horizontally parallel to a transfer passage 25 of the stock conveyor 20, the transfer passage 25 is preferably provided just under the rail 10. Further, although FIG. 2 illustrates that twelve roving bobbins are conveyed as a unit set, the number of the roving bobbins as the unit set may be arbitrarily modified in accordance with the number of the fine spinning frames.

Figure 3:
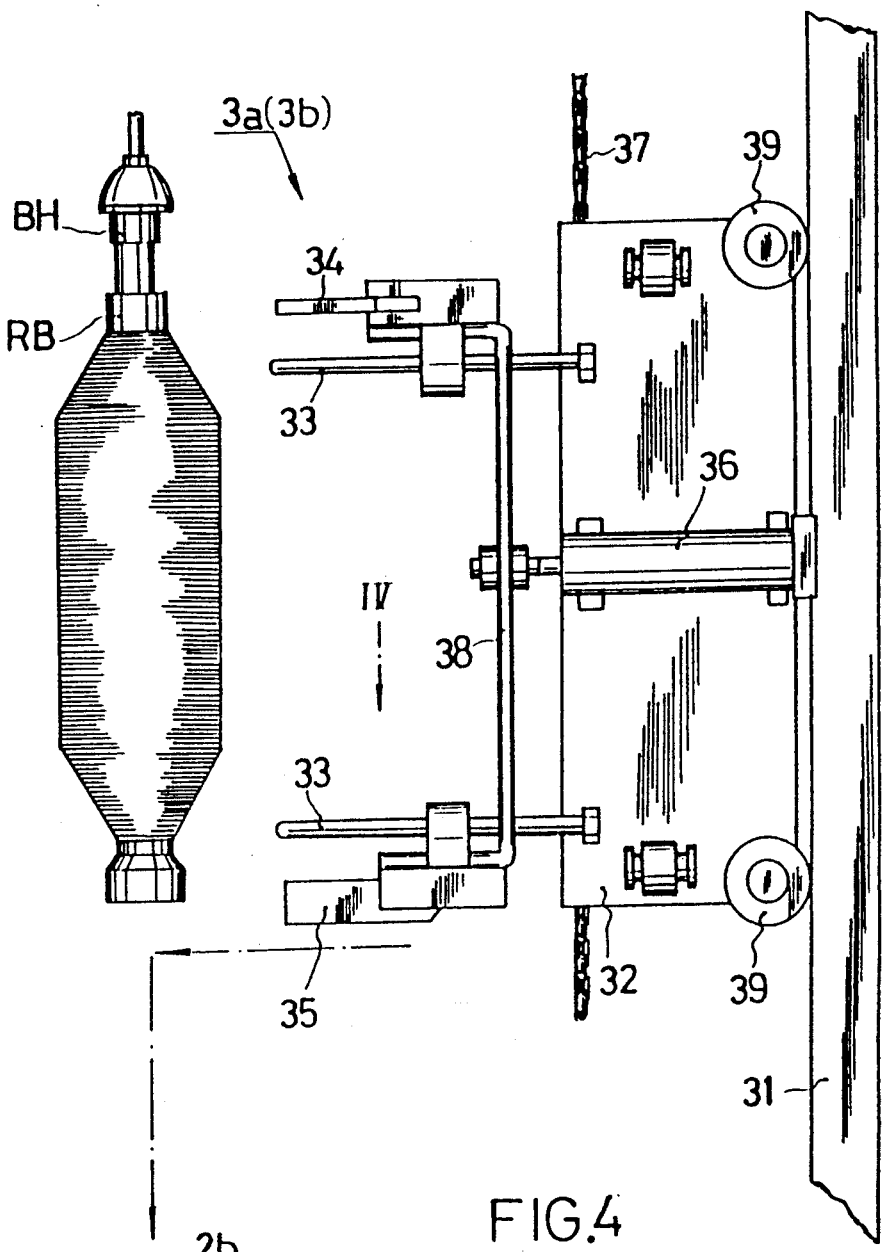
FIG. 3 is a side view of an essential part of a transfer mechanism shown in FIG. 2.

A vertical section of the stock conveyor 20 is shown at a lower portion of FIG. 3, wherein the stock conveyor 20 is constructed of a pair of guide rails 29*a* and 29*b* each having a U-shaped cross section, a driving belt 28 having a round cross section, and a plurality of conveying trays 2 between the guide rails 29*a* and 29*b*. Each of the trays 2 is constructed of a circular base 2*a* and an insert pin 2*b* formed on the circular base 2*a* which pin is to be inserted into a lower opening of an axial hole of each roving bobbin RB, so that each roving bobbin RB standing on the corresponding tray 2 is conveyed together with the tray 2 along the guide rails 29*a* and 29*b*.

Referring back to FIG. 2, the first transfer mechanism 3*a* is provided aside the transfer passage 25 of the stock conveyor 20. The first transfer mechanism 3*a* functions to remove the unwound roving bobbins from bobbin hangers BH of the carrier line 1 and transfer the roving bobbins onto the trays 2 of the stock conveyor 20. The second transfer mechanism 3*b* is also provided aside the transfer passage 25 on the downstream side of the first transfer mechanism 3*a*, that is, on the roving frames side. The second transfer mechanism 3*b* functions to transfer blank roving bobbins located on the transfer passage 25 to the bobbin hangers BH of the carrier line 1.

The stock conveyor 20 includes an unwound roving bobbin storing passage 21 for storing the unwound roving bobbins transferred by the first transfer mechanism 3*a*. An outlet of the storing passage 21 is connected to an inlet of the residual roving removing device 50. An outlet of the residual roving removing device 50 is connected to a blank bobbin storing passage 22 for storing blank bobbins from which a residual roving has been completely removed. An outlet of the blank bobbin storing passage 22 is connected to the transfer passage 25 opposed to the second transfer mechanism 3*b*. In this preferred embodiment, a backup device 100 for completely removing a residual roving from the roving bobbins discharged from the residual roving removing device 50 is provided in a bypass passage 23 connected to a main passage of the stock conveyor 20 between the residual roving removing device 50 and the blank bobbin storing passage 22. However, the provision of the backup device 100 is optional according to the present invention.

Figure 4:
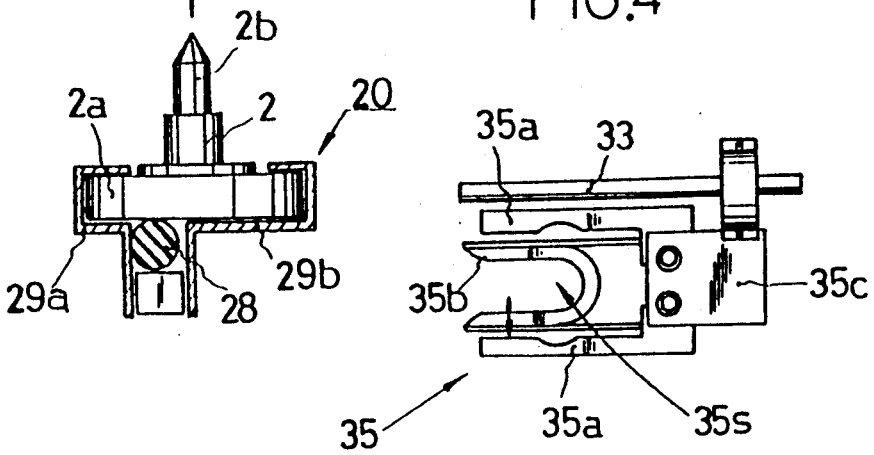
FIG. 4 is a top plan view taken in a direction depicted by an arrow IV in FIG. 2.

FIG. 3 is a side view of an essential part of the first and second transfer mechanisms 3*a* and 3*b* shown in FIG. 2. The transfer mechanism 3*a* (3*b*) is primarily constituted of a vertically movable base 32 adapted to be raised and lowered along a vertical rail 31 by driving a chain 37 and roving bobbin supporting device 38 mounted to the vertically movable base 32. That is, the roving bobbin supporting device 38 is mounted through an expansion/contraction cylinder 36 to the vertically movable base 32 so as to be movable toward and away from the roving bobbin RB hung by the bobbin hanger BH. More specifically, the roving bobbin supporting device 38 is slidable along a pair of upper and lower guide bars 33 mounted to the vertically movable base 32. A pair of upper and lower gripping members 34 and 35 are provided at upper and lower portions of the supporting device 38, respectively. The gripping members 34 and 35 are so driven as to grip upper and lower end portions of the roving bobbin RB and release the gripping condition. For example, the gripping member 35 is constructed as shown in FIG. 4. Referring to FIG. 4, the gripping member 35 is constructed of a bottom support 35*b* having a U-shaped recess 35*s*, a pair of grip handles 35*a* provided on the opposite sides of the bottom support 35*b*, and a driving device 35*c* for opening and closing the grip handles 35*a*. Accordingly, the lower end portion of the roving bobbin RB can be gripped by engaging the U-shaped recess 35*s* of the bottom support 35*b* with the lower end portion of the roving bobbin RB and then closing the grip handles 35*a*. Similarly, the upper end portion of the roving bobbin RB can be gripped by the upper gripping member 34. Thus, the roving bobbin RB can be supported by the supporting device 38. In removing the roving bobbin RB from the bobbin hanger BH, the vertically movable base 32 is slightly raised to retract a stopper pawl of the bobbin hanger BH and thereby disengage the roving bobbin RB from the bobbin hanger BH. Then, the roving bobbin RB is lowered by lowering the vertically movable base 32 until the lower opening of the axial hole of the roving bobbin RB comes into engagement with the insert pin 2*a* of the tray 2. Thus, the roving bobbin RB is transferred from the bobbin hanger BH of the carrier line 1 to the tray 2 of the stock conveyor 20 by the first transfer mechanism 3*a*. In contrast, when the above transfer operation is reversely carried out, the roving bobbin RB standing on the tray 2 can be transferred to the bobbin hanger BH by the second transfer mechanism 3*b*. The construction of the first and second transfer mechanism 3*a* and 3*b* is not limited to the above but any known mechanisms utilizing an expansion/contraction cylinder and a hoisting wire, for example, may be employed.

Figure 5:
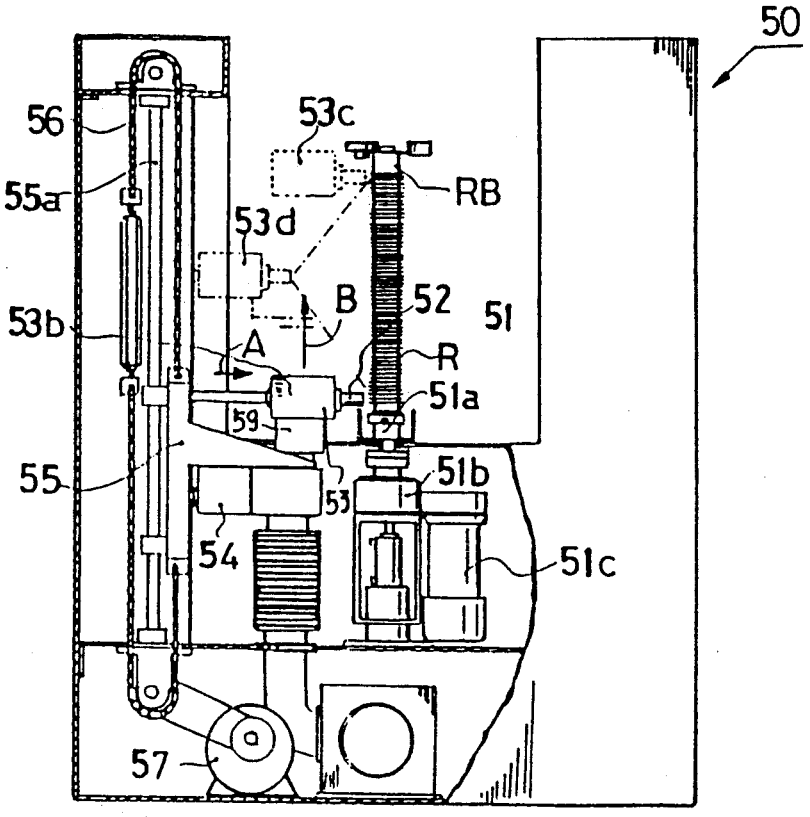
FIG. 5 is a partially cut-away side view of a preferred embodiment of a residual roving removing device shown in FIG. 2.
Figure 6:
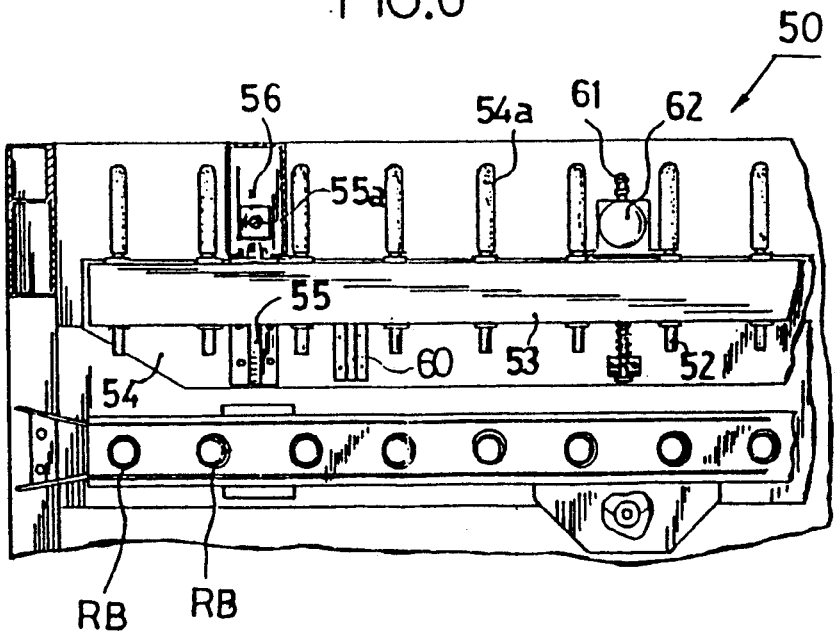
FIG. 6 is a partially cut-away plan view of FIG. 5.

FIGS. 5 and 6 show a preferred embodiment of the residual robing removing device 50. Referring to FIGS. 5 and 6, a plurality of roving bobbins RB are rotatably supported to a rotary driving device 51. The rotary driving device 51 is constructed of a plurality of pins 51*a* to be inserted into the lower openings of the corresponding roving bobbins RB, a plurality of rotary driving portions 51*b* connected to the corresponding pins 51*a* for rotating the same, and a control motor 51*c* for driving the rotary driving portions 51*b* with a rotating speed of the roving bobbins RB being variably controlled.

A plurality of suction nozzles 52 are provided in opposed relationship to the corresponding roving bobbins RB in such a manner as to be movable vertically and horizontally. The suction nozzles 52 are supported to an elongated retainer box 53 in such a manner as to project therefrom to the side of the roving bobbins RB. The retainer box 53 is movably mounted on guide rails 60 so as to be moved horizontally toward and away from the array of the roving bobbins RB by means of a screw shaft 61 and a driving motor 62. The guide rails 60 are mounted on a vertically movable support 55 which is connected through an endless chain 56 to a driving motor 57. Accordingly, when the driving motor 57 is rotated normally or reversely, the retainer box 53 is raised or lowered.

Figure 7:
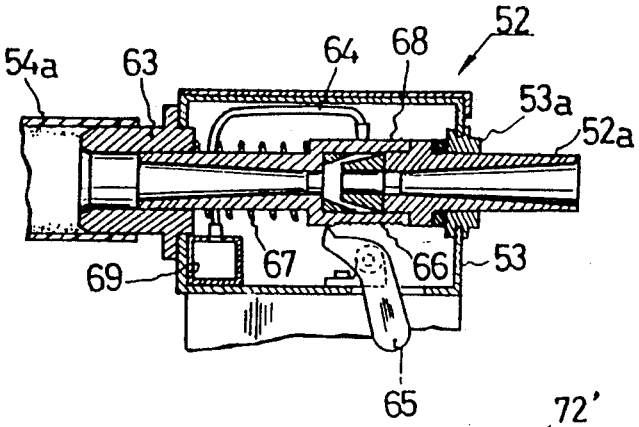
FIG. 7 is a vertical sectional view of a suction nozzle shown in FIG. 5.

Referring to FIG. 7 which shows a structure of each suction nozzle 52 of a pressure air introducing type, a front portion 52*a* of the nozzle 52 is retractably engaged through a packing 53*a* to the retainer box 53, and a rear portion 52*b* of the nozzle 52 is slidably inserted in a hollow bracket 63 fixed to a rear wall of the retainer box 53. An intermediate portion 68 of the nozzle 52 between the front portion 52*a* and the rear portion 52*b* is formed with a pressure air introducing portion connected through a flexible hose 64 to a pressure air duct 69. Further, the intermediate portion 68 is formed at its outer circumference with a continuous groove 66 engaging a pawl 65. With this construction, a pressure air is injected from the pressure air introducing portion toward the rear portion 52*b* of the nozzle 52 so that a suction air flow due to a negative pressure may be generated in the front portion 52*a* to thereby suck a residual roving on the roving bobbin RB into the nozzle 52. A plurality of pressure air nozzles constituting the pressure air introducing portion are preferably inclined or twisted with respect to an axis of the nozzle 52 so as to swirl the suction air flow in an untwisting direction of the residual roving. Accordingly, the residual roving may be changed into an untwisted fiber, and the untwisted fiber is discharged through a suction hose 54*a* connected with the bracket 63 to a collecting device (not shown).

In removing the residual roving on the roving bobbins RB by using the residual roving removing device 50 of the suction nozzle type having the above-mentioned structure, the retainer box 53 is first moved toward the roving bobbins RB until the front portions 52*a* of some of the suction nozzles 52 are brought into contact with the outer circumferential surfaces of the blank bobbins, if any. At this time, the front portions 52*a* of the other suction nozzles 52 having been brought into contact with the outer circumferential surfaces of the roving bobbins RB having the residual roving are retracted in the retainer box 53, and a retracted position of each suction nozzle 52 is maintained by the engagement of the pawl 65 with the continuous groove 66. Then, the retainer box 53 is retracted by a distance of 5–10 mm, and is then vertically moved as rotating the roving bobbins RB at low speeds, so as to suck an end portion of the residual roving into the suction nozzle 52. Then, the retainer box 53 is further retracted to a position 53*d* as shown in FIG. 5, and the roving bobbins RB are rotated in an unwinding direction of the residual roving at high speeds, thus removing the residual roving from the roving bobbins RB.

The construction of the residual roving moving device 50 is not limited to the above. For example, the vertical movement and the horizontal movement of the suction nozzles 52 may be effected by any other known moving means. Further, the suction nozzles 52 may be connected to a vacuum pump or the like. As to the method of removing the residual roving, a method of re-removing a residual roving on a flock belt of each roving bobbin may be added, or a method of detecting a residual roving amount with use of a residual roving sensor may be combined with the above-mentioned removing method.

Figure 8:
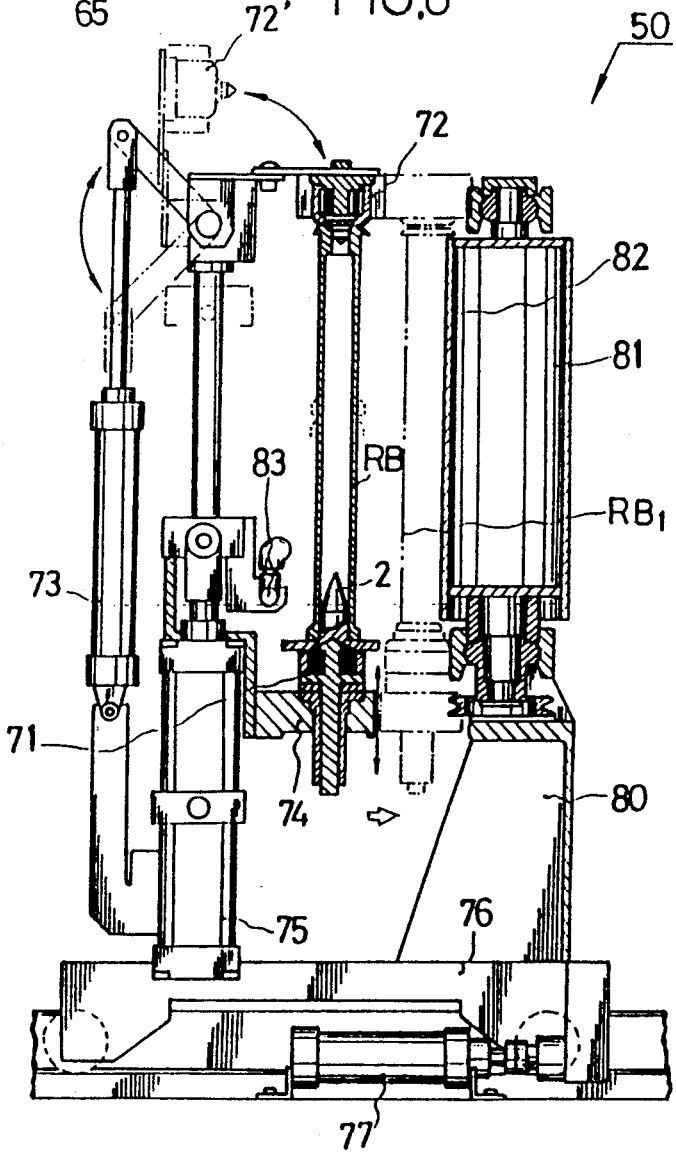
FIG. 8 is a partially sectional side view of another preferred embodiment of the residual roving removing device.

FIG. 8 shows another preferred embodiment of the residual roving removing device 50. Referring to FIG. 8, each unwound roving bobbin RB having a residual roving is rotatably supported with the corresponding tray 2 by means of supporting devices 71 and 72. A flock belt 82 is movably provided in opposed relationship to the roving bobbin RB so as to be moved in an unwinding direction of the residual roving. In removing the residual roving, the roving bobbin RB standing on the tray 2 supported by the supporting devices 71 and 72 is moved horizontally in a direction depicted by an arrow P until contacting the flock belt 82, with the result that the residual roving on the roving bobbin RB may be removed by the flock belt 82 rotating in the unwinding direction. Furthermore, an air injection mechanism 83 for blowing an end of the residual roving is vertically movably provided aside the roving bobbin RB. The above-mentioned construction of the residual roving removing device 50 is merely illustrative, and any other known constructions of the device 50 may be employed.

Figure 9:
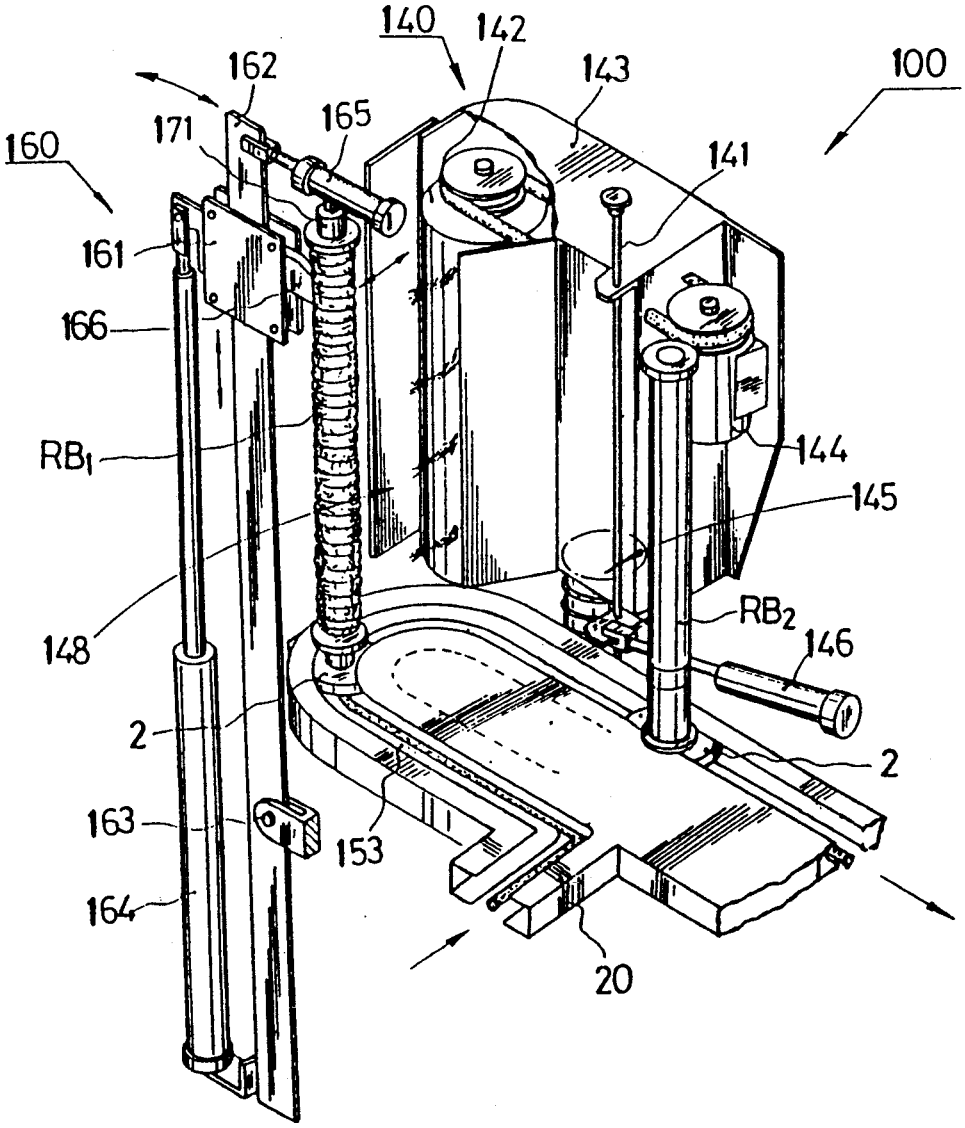
FIG. 9 is a perspective view of a preferred embodiment of a backup device shown in FIG. 2.

Even after passing the residual roving removing device 50, there is a case where the residual roving is still left on the roving bobbins RB. In this case, the roving bobbins RB still having the residual roving are converted into completely blank roving bobbins by using the backup device 100. FIG. 9 is a perspective view of a preferred embodiment of the backup device 100. As shown in FIG. 9, a roving bobbin $RB_1$ having a residual roving conveyed with the tray 2 to the backup device 100 is once stopped at a fixed position in a conveyor passage 153 by a stopper (not shown). Then, a swing rail 162 swinging about a pin 163 approaches the roving bobbin $RB_1$, and a cutter mechanism 161 vertically movably supported to the swing rail 162 is moved in an axial direction of the roving bobbin $RB_1$ to cut the residual roving. Then, a flock rotary drum 142 pivotably supported to a pivotal shaft 141 is pivoted to contact the roving bobbin $RB_1$ and strip off the residual roving on the roving bobbin $RB_1$. The residual roving removed in this manner is discharged through a duct 145 to the collecting device, and a blank roving bobbin $RB_2$ thus obtained is conveyed out of the backup device 100.

There will now be described the operation of the present invention with reference to FIG. 2, wherein the stock conveyor unit C is utilized to convert the unwound roving bobbins into the blank roving bobbins and convey the blank roving bobbins to the roving frames $R_1$–$R_n$. The unwound roving bobbins conveyed from the fine spinning frames along the carrier line 1 in a direction depicted by an arrow $B_{10}$ are stopped at a position aside the first transfer mechanism 3*a*. Then, the roving bobbins hung by the bobbin hangers BH are transferred from the bobbin hangers BH to the trays 2 on the transfer passage 25 of the stock conveyor 20 by means of the first transfer mechanism 3*a*. In this transfer operation, the trays 2 are maintained in a stopped condition by a stopper 27*a*. Then, the bobbin hangers BH disengaged from the roving bobbins by the first transfer mechanism 3*a* are fed to a position aside the second transfer mechanism 3*b* and are stopped at this position. Then, the blank bobbins previously stored in the blank bobbin storing passage 22 and conveyed to the transfer passage 25 opposed to the second transfer mechanism 3*b* are transferred to the bobbin hangers BH by the second transfer mechanism 3*b*. In this transfer operation, the trays 2 on the transfer passage 25 are maintained in a stopped condition by a stopper 27*b*. Then, the bobbin hangers BH having the blank bobbins are conveyed along the carrier line 1 to the roving frames in a direction depicted by an arrow $B_{11}$. Thus, the unwound roving bobbins from the fine spinning frames can be replaced with the completely blank roving bobbins and be fed to the roving frames by only twice stopping the conveyance of the roving bobbins on the carrier line and transferring the roving bobbins. As a required time for such a series of operation is short, the conveyance of the full wound roving bobbins from the roving frames to the fine spinning frames on the single carrier line 1 is not adversely affected by the conveyance of the blank roving bobbins to the roving frames.

On the other hand, the unwound roving bobbins transferred onto the trays 2 on the transfer passage 25 by the first transfer mechanism 3*a* are stored in the storing passage 21, and are then conveyed in directions depicted by arrows $C_1$ to $C_2$ to enter the residual roving removing device 50. In the residual roving removing device 50, The residual roving attached to the roving bobbins is removed. Although a large part of the roving bobbins discharged from the residual roving removing device 50 is converted into the blank roving bobbins, there is a case that several percents of the roving bobbins discharged from the device 50 still have a residual roving. Therefore, a residual roving sensor 26 (e.g., optical sensor or ultrasonic sensor) is provided at a branch point between the bypass passage 23 and the main passage downstream of the device 50. Thus, the roving bobbins having the residual roving as detected by the sensor 26 are conveyed in a direction depicted by an arrow $C_4$ to enter the bypass passage 23, and are treated by the backup device 100 provided in the bypass passage 23 to obtain the completely blank bobbins. The other blank bobbins having no residual roving as not detected by the sensor 26 are conveyed in a direction depicted by an arrow $C_3$.

Thereafter, all the blank bobbins joined on the downstream side of the backup device 100 are conveyed in a direction depicted by an arrow $C_5$ to enter the storing passage 22. In the storing passage 22, a suitable number of the blank bobbins are stored, and are supplied to the transfer passage 25 as required. The trays 2 separated from the blank bobbins on the transfer passage 25 are moved in a direction depicted by an arrow $C_6$ to the position opposed to the first transfer mechanism 3*a*, and they are maintained ready for the subsequent transfer operation of the unwound roving bobbins.

Although the stock conveyor 20 employs the independent conveying trays in the above preferred embodiment, it may employ a chain conveyor or a belt conveyor having a plurality of pins to be engaged with the roving bobbins.

As described above, the full wound roving bobbins and the unwound roving bobbins (inclusive of the blank roving bobbins obtained by removing the residual roving) can be efficiently conveyed on a single carrier line.

Further, as the stock conveyor unit C can be provided three-dimensionally with respect to the carrier line 1, a factory site area can be effectively reduced.

What is claimed is:

1. A roving bobbin carrier system comprising:

a carrier line for conveying a plurality of full wound roving bobbins and a plurality of unwound roving bobbins between a fine spinning frame and roving frame;

a stock conveyor provided aside carrier line independently thereof;

a first transfer mechanism provided at a first part of said stock conveyor for transferring said unwound roving bobbins on said carrier line to said stock conveyor;

a second transfer mechanism provided at a second part of said stock conveyor for transferring a plurality of blank roving bobbins on said stock conveyor to said carrier line; and a residual roving removing device provided in said stock conveyor for removing a residual roving from said unwound roving bobbins to provide said blank roving bobbins; wherein at least one of said first and second transfer mechanisms comprises a vertical rail, a vertically movable base adapted to be raised and lowered along said vertical rail and roving bobbin supporting device adapted to be horizontally moved relative to said vertically movable base, said roving bobbin supporting device being formed with a pair of grip handles for gripping upper and lower end portions of each said roving bobbin; and wherein wherein said stock conveyor forms a closed loop such that said roving bobbins on said conveyor are circulated.

2. The roving bobbin carrier system as defined in claim 1, wherein said carrier line is provided with a hanger rail for suspending and moving a plurality of bobbin hangers; said stock conveyor is provided with a pair of guide rails each having a U-shaped cross section, a driving belt having a round cross section located between said guide rails, and a plurality of trays provided between said guide rails for supporting said roving bobbins; and said first and second parts of said stock conveyor are located just under said carrier line.

3. The roving bobbin carrier system as defined in claim 1 or 2, wherein said stock conveyor comprises a first storing passage for storing said unwound roving bobbins discharged from said fine spinning frame, a second storing passage for storing said blank roving bobbins, and a transfer passage to be used for transferring of said unwound roving bobbins and said blank roving bobbins.

4. The roving bobbin carrier system as defined in either claim 1 or claim 2, further comprising a backup device provided on a discharge side of said residual roving removing device for removing the residual roving still attached to said roving bobbins discharged from said residual roving removing device.

5. The roving bobbin carrier system as defined in claim 4, wherein said backup device comprises a cutter mechanism adapted to be swingably moved toward and away from said roving bobbins for cutting the residual roving attached to said roving bobbins in an axial direction of each bobbin, and a rotating drum adapted to be moved toward and away from said roving bobbins for stripping off the residual roving after being cut by said cutter mechanism.

6. The roving bobbin carrier system as defined in either claim 1 or claim 2, wherein said residual roving removing device comprises a plurality of suction nozzles opposed to said roving bobbins and adapted to be moved in horizontal and vertical directions, and a rotary driving device for rotating and retaining said roving bobbins.

7. The roving bobbin carrier system as defined in claim 1, wherein said residual roving removing device comprises a pair of upper and lower supporting devices for rotatably supporting said roving bobbins and a flock belt movably mounted aside said roving bobbins, said upper and lower supporting devices being movable in a horizontal direction toward and away from said flock belt.

* * * * *